US009593909B2

(12) United States Patent
McRee

(10) Patent No.: US 9,593,909 B2
(45) Date of Patent: Mar. 14, 2017

(54) EMBEDDED CANT INDICATOR FOR RIFLES

(71) Applicant: Scott McRee, McCarley, MS (US)

(72) Inventor: Scott McRee, McCarley, MS (US)

( * ) Notice: Subject to any disclaimer, the term of this patent is extended or adjusted under 35 U.S.C. 154(b) by 0 days.

(21) Appl. No.: 14/842,925

(22) Filed: Sep. 2, 2015

(65) Prior Publication Data

US 2016/0298928 A1 Oct. 13, 2016

Related U.S. Application Data

(62) Division of application No. 14/154,214, filed on Jan. 14, 2014, now Pat. No. 9,170,067.

(51) Int. Cl.
*F41G 1/44* (2006.01)
*F41C 27/00* (2006.01)

(52) U.S. Cl.
CPC ..... *F41G 1/44* (2013.01); *F41C 27/00* (2013.01)

(58) Field of Classification Search
CPC ..... F41C 27/00; F41C 27/22; F41C 23/14; F41G 1/44; F41G 3/10; F41A 35/00
USPC ..... 42/90, 123–125, 113; 89/37.13, 41.19; 33/373
See application file for complete search history.

(56) References Cited

U.S. PATENT DOCUMENTS 168,941 A * 10/1875 Treadway ..... G01C 9/28 33/373
5,315,781 A * 5/1994 Beisner ..... F41G 1/44 42/1.01
5,406,733 A * 4/1995 Tarlton ..... F41G 1/44 33/292
5,878,504 A * 3/1999 Harms ..... F41G 1/545 33/286
6,813,855 B2 * 11/2004 Pinkley ..... F41G 1/44 33/286
8,316,571 B1 * 11/2012 Holland ..... 42/108
8,819,985 B1 * 9/2014 McCoy ..... F41G 1/54 33/373
9,015,982 B1 * 4/2015 Powers ..... F41G 1/44 42/119
2004/0148841 A1 * 8/2004 Burzel ..... F41G 1/44 42/123
2007/0113460 A1 * 5/2007 Potterfield ..... F41G 1/44 42/120
2008/0134561 A1 * 6/2008 Clouser ..... F41G 1/42 42/113
2014/0090259 A1 * 4/2014 Stockdill ..... F41G 1/12 33/298

OTHER PUBLICATIONS

NPL: Feb. 17, 2010, post #22; http://www.calguns.net/calgunforum/showthread.php?t=270390.*

* cited by examiner

*Primary Examiner* — John D Cooper
(74) *Attorney, Agent, or Firm* — Mark O. Loftin

(57) ABSTRACT

A device comprised of bubble level embedded into a solid block of material and located above the rifle grip and behind the barrel to facilitate the measurement and compensation of the rifle's cant while lining up the rifle's sights. The device is precision machined to allow the bubble to be aligned with the axis of the barrel to produce a true "zero-cant" condition. Graduation markings are placed on either left or right of the bubble level to allow the user to judge the relative degree of cant. Methods of using the embedded cant indicator for precision shooting are presented.

4 Claims, 4 Drawing Sheets

EMBEDDED CANT INDICATOR FOR RIFLES

CROSS-REFERENCES

This is a Divisional Application from U.S. nonprovisional application Ser. No. 14/154,214 and claims all priority to the aforementioned application.

FIELD OF THE INVENTION

This invention relates generally to rifle style firearms, and particularly concerns both apparatus and methods for readily and precisely determining the cant of the rifle relative to the target such that the shooter can make appropriate aim adjustments to improve the probability of hitting the target. The location of the cant measurement device is designed to facilitate the shooters assessment of the rifle's cant when viewing other sighting means on the rifle.

BACKGROUND OF THE INVENTION

Accuracy in placing a projectile onto a target using a rifle requires the shooter to determine three primary elements: 1) distance to the target, 2) the incline of the projectile as it leaves the rifle, and 3) the cant of the rifle at the moment the projectile leaves the rifle. The rifle cant is defined as the degree of rotational tilt the rifle has along the axis of the rifle barrel. Distance and incline are part of "sighting" a rifle to a target and generally require several elements that must be determined by the shooter. Since gravity tends to bring the projectile downward, an incline of the barrel must often be made to hit a target at some distance. Commonly used sights for setting the incline can be a groove or aperture at the rear end of the post or the point at the barrel end-muzzle. Once the shooter determines a point at which the projectile is aimed, the shooter uses one eye to align the post into the groove, which effectively aligns the rifle both horizontally and vertically to the point of aim.

However, such sighting means may not offer the shooter with the degree of accuracy that may be desired. To improve the accuracy of the horizontal and vertical alignment, some rifle assemblies make use of a magnification means, referred to as a scope. A scope typically provides the shooter with a glass view port displaying horizontal and vertical lines in addition to a magnified view of the point of aim. Scopes incorporate vertical and horizontal adjustment means. The shooter simply makes the calculated vertical and horizontal adjustments to account for situational issues such as wind, temperature, and distance and aligns the point of aim with the intersection of these two lines, commonly referred to as cross-hairs. Scopes can contain a system of lines, dots, cross hairs, wires, or electrically projected images which aid aligning the barrel to the point of aim. Scopes are generally mounted on top of the action assembly near the back end of the barrel of the rifle and are attached thereto with some means for adjustment. A common adjustment means is a ring and slotted bar-rail device also known as scope rings and scope bases. These adjustments are typically made at a shooting range or target practice area where the rifle is placed in a holder to ensure proper alignment and target distances are accurately known. Using this method, a rifle and scope can be adjusted to provide the shooter with a high degree of accuracy.

However, using a holder at a shooting range for calibrating a rifle's proper incline as a function of distance to the target often does not represent real world situations where the shooter is either standing or prone with the rifle being held at the time of firing. In these situations, the rifle is often twisted or rotated about the axis of the barrel. The physics of projectile firing is greatly affected by this degree of rotation or "cant" of the rifle at the moment of firing. For example, a left angle of cant tends to result in the shot being to the lower left of the point of aim. Shooters, especially competition target shooters, must compensate for the cant of the rifle to improve shot accuracy.

Various means have been presented in the prior art to provide feedback to the shooter of the degree of cant during their aim. One such example is U.S. Pat. No. 6,813,855 where Pinkley presents an apparatus where among other accompanying pieces, a bubble level is strapped to the rifle stock underneath the scope. Pinlkley's cant compensation method involves the steps of positioning the firearm and scope with a canted reticle system so that its vertical axis is positioned as indicated by the level bubble of the mounted level sub-assembly, positioning the vertical reference shaft sub-assembly a distance from the muzzle end of the firearm. The shooter then rotates the scope on the firearm sufficiently to align the vertical cross hair of the scope reticle system with the distant vertical reference shaft sub-assembly. Lastly, the shooter locks the sighting scope in the corrected position on the firearm.

The prior art attempts to provide the shooter with feedback for the cant of the rifle tend to be attached to the scope and as such are accessories that must be carefully assembled to the scope and are not suitable for shooting situations where speed and durability are required. Also, the prior art cant measurement systems themselves must be thoroughly tested and calibrated by the shooter so that typically only that shooter, with that cant feedback device, on that special rifle, and carefully calibrated by a trained technician can be used to produce the degree of accuracy in critical or competitive shooting environments.

It has been discovered that by locating a pre-calibrated bubble level between the shooter's eye and the scope and carefully machining the bubble level within the rifle system, a reliable cant feedback system can be readily made available to any shooter and repeatable across an entire weapon platform. Also, by carefully embedding the bubble level within the body of the rifle, the cant feedback method can be durable and repeatable for a whole range of shooting applications, especially for the war-fighter.

Additionally, by embedding the cant feedback means into the rifle's stock and providing an accurate measurement of the rifle's cant, calibrating the firearm is greatly facilitated. By placing a plumb line at the desired target calibration distance (100 yards or 100 meters, for example), and then aligning the vertical reticle of the scope with the rifle at zero cant, the scope reticle-aiming reference are "trued" to the cant axis of the rifle. Once this initial process is completed, the rifle and scope are now calibrated for a "zero-cant" condition relative to each other.

SUMMARY OF THE INVENTION

The present invention presents an embedded precision level means that provides a true reference to level or plumb allowing for the final cant correction to be made before the shot is taken. The present invention provides the rifle shooter with a tool that greatly enhances "first-round-hit" probabilities and increases overall accuracy. The invention is located so that the rifle shooter does not have to change or disturb his body position to monitor the cant of the rifle.

The invention is machined in to the rifle stock component during a process that is aligned with the horizontal axis of the center line. This horizontal axis is perpendicular to the center line referenced from top to bottom. This axis can also be described as the 3 o'clock to 9 o'clock "cant axis". This invention can now provide the rifle shooter with one more calculation used in making the prefect shot. This feedback is of critical importance because cant measuring mechanisms of the prior art did not solve the issue of "man-introduced-errors" because the mounting of the cant level indicator is often not performed by a specially trained technician. These specially-trained technicians often included several items installed for reference points with none of them truly being calibrated to the horizontal plane, initially.

The invention presented herein is machined into the assembly on the same plane as the cant axis. The invention location is absolutely true to the Cant Axis because it is machined with computer-aided precision. A set of cant reference gradients is machined into the assembly as well. The Reference gradients allow for duplicating the cant if a "Zero Cant" condition is not achievable. The shooter can perform a quick calculation that formulates the amount of "Point of Aim" adjustment required to successfully engage the target due to the amount of Cant introduced into the rifle. This combination of location, precision machining and calibration feedback allows shooters with much less experience and in situations of duress to greatly improve shot accuracy.

The invention herein presents methods of using the embedded cant indicator to provide a shooter with an optimized and compensated alignment system that maximizes the accuracy and repeatability of hitting the shooter's target and provides a weapon system that achieves this high level of precision compensation between the target and weapon in a most convenient manner.

DETAILED DESCRIPTION

Figure 1:
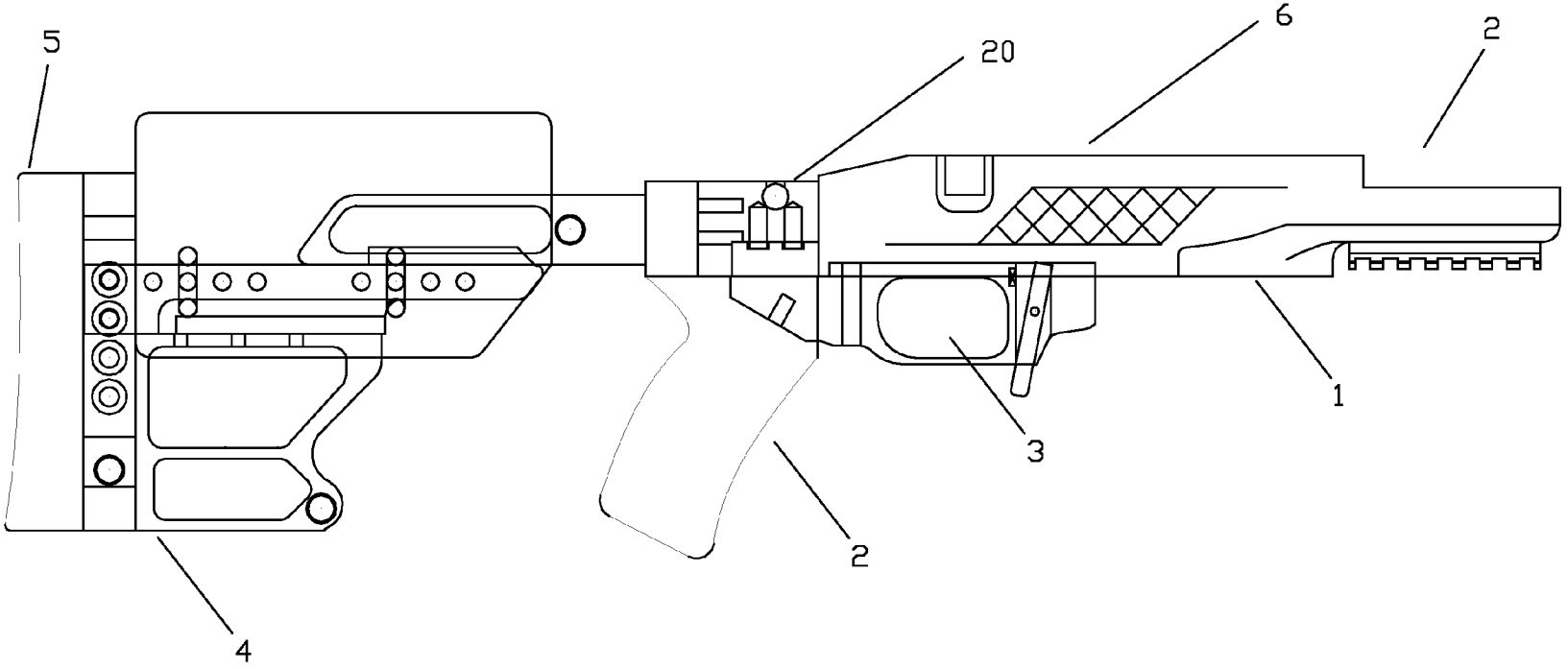
FIG. 1 is a perspective view of the invention apparatus located in its position relative to the stock of the rifle and overall weapon platform. The barrel of the rifle and the sighting means are not shown but it is understood to one skilled in the art where these components would be located on this rifle stock assembly.

FIG. 1 illustrates the preferred embodiment of the invention as an element of an overall weapon assembly. This weapon assembly is comprised of multiple parts that are bolted together to provide a functioning rifle. In its most basic form, this particular weapon platform is comprised of a central stock 1, the cant indicator 20, the butt of the rifle 4, a recoil absorbing pad 5. The barrel of the rifle would attach at point 2. If the shooter desired a scope, it would be attached to the central stock at 6. As the shooter holds the weapon and views at the target through the scope in a direction parallel to the axis of the rifle barrel, the cant indication would be obtained by glancing downward at a bubble contained within the cant indicator assembly 20. By using the calibration lines, as will be further described in later Figures, the position of the bubble to the left or right of the center line will indicate the extent with which the rifle is tilted about the axis of the barrel. A shooter can either rotate the weapon to eliminate the cant or make the appropriate adjustment to the point of aim at the target. As has been learned from competition shooting, extreme accuracy of hitting the target typically requires a precisely trained and practiced shooter and a custom-set rifle that is calibrated to the shooters particular method of holding and aiming the firearm. Cant compensation is critical to improving shot accuracy. The special relationship between the shooter and his weapon i.e., knowing where the projectile will travel when aimed this particular way on this particular gun is extremely important high-accuracy shooting. Modern ballistic software-based calculators also have a function that the shooter can input the cant offset and the appropriate aim corrections are computed and displayed. The present invention allows the same level of high-accuracy shooting because every cant indicator is precisely machined and attached to the particular stock design which employs the device. Therefore, a given shooter can pick up any weapon with the invention installed and the cant compensation will be precise and repeatable. Now, a trained shooter has multiple weapons each with a predictable response to cant compensation.

This eliminates the need for a shooter having only one rifle which they can use that is set up by a specialist for high-accuracy shooting. In addition, more shooters can be trained because more weapons would be available with high-accuracy cant compensation systems.

Figure 2:
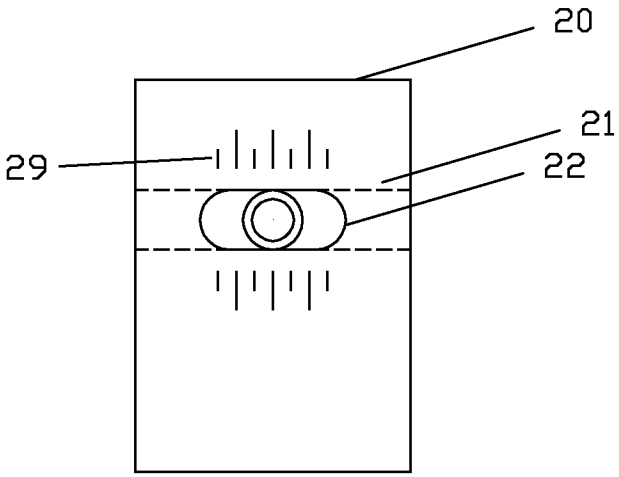
FIG. 2 top side view of the invention showing the bubble and calibration marks.

FIG. 2 illustrates a top view of the section of the rifle containing the precision-machined bubble-level system that comprises the invention. In the preferred embodiment of the invention, the device is machined out of a solid block of steel 20. Other materials can also be used depending on the level of cost and durability desired. The dashed lines 21 indicate a tubular cavity that is machined out of the block through from one side but does not extend completely through to the other side. This allows the bubble level tube to be inserted or removed from one side and when pushed in, is held in proper place by contacting the closed end of the cavity. This cavity length is also precisely machined so that the bubble level when inserted is correctly aligned to the gradient markings 29. The diameter of the cavity is machined with very close tolerances (0.001" typically) to the diameter of the bubble-level inserted therein. The length and width of the cavity 21 are dictated by the diameter and length of the particular bubble-level incorporated into the weapon system. In one embodiment, the bubble level is 0.375" in diameter and the length is 1.500." An oval-shaped viewport 22 is machined into the top face that allows the shooter to view the bubble level tube that is inserted into the cavity. A bubble-level comprised of a glass or plastic tube sealed on both ends and containing a phosphorous liquid or other fluorescent liquid, but not completely filled, such that a bubble exists within the sealed tube. In this Figure, gradient markings 29 are spaced apart evenly along both the top edge and bottom edge of the viewport 22. These markings provide a reference point for the shooter to judge the level of cant displayed by the movement of the bubble within the level either to the left or right of true center. The markings are evenly spaced but are primarily for consistent reference and do not represent any actual degree of rotation. Once the shooter practices the firing the weapon in a canted situation, the location of the bubble relative to the left or right count of the markings is sufficient for the shooter to be accurate in cant compensation in other shooting circumstances. The gradients can be converted to actual degree of cant rotation simply by field calibration. This may be desirable, for example, if the shooter is using a ballistics software program that requires degree of rifle cant an input value to the calculation.

Figure 3:
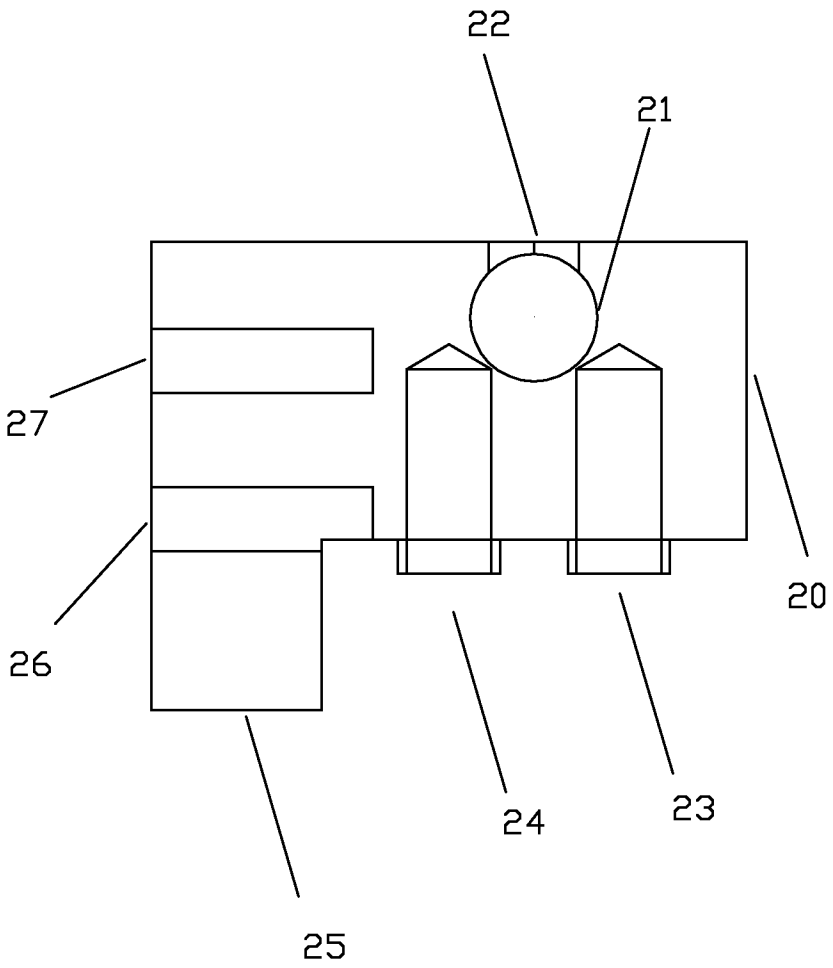
FIG. 3 is a left side view of the invention showing the various compartments housing the bubble level and interfacing with the remained of the rifle components.

FIG. 3 illustrates a side view of the current invention showing the various elements machined into the block of steel 20 or other solid material. Items 23 and 24 are drilled and tapped to receive an attachment means, such as machine screws, for attaching the invention to the section of the stock above the grip of the stock. In the preferred embodiment, these machine screws are ¼" diameter×⅝" length and tapped to standard machine threads. All external surfaces of the invention are machined to flat to ensure that the device attaches securely and aligned properly to the other elements of the weapon stock. When in properly place on the weapon stock, these two screws point upward and secure the device to the stock assembly. In the preferred embodiment items 26 and 27 are machined and tapped cavities to receive four attachment means. This attachment means secures and aligns the device from the rear end. In the preferred embodiment, these attachment means are 10⁄32" machine bolts. The invention also includes a contact base 25 that extends down below the back end of the central stock. This left side of this extended surface provides a contact surface for attaching a folding hinge piece or any other accessory item bolting on to the back end of the central stock.

Figure 4:
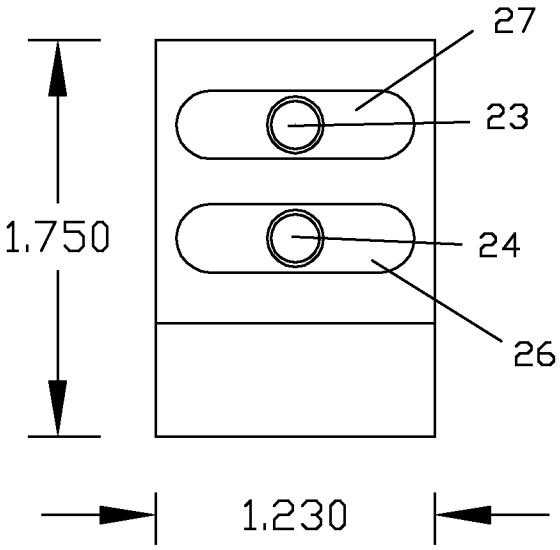
FIG. 4 is bottom view of the preferred embodiment of the invention indicating length and width dimensions.

In reference to FIG. 4, the bottom view of the invention shows the two threaded holes 23 and 24. In addition to securing the invention to the central stock via these attachment means, two ovular sections 26 and 27 are machined out of the invention for receiving similarly-shaped raised sections that are part of the central stock where the invention is placed. This "tongue and groove" style connection means ensures that the invention is properly aligned and located relative to other components that make up the weapon assembly. This connection means also adds strength to the invention to handle the stresses of firing the rifle and the weight of the stock components that are bolted to the invention. In the preferred embodiment, the height and width of the invention is 1.75" and 1.23" respectively. However, it is understood that the dimensions of the invention are relative to the size of the bubble level device incorporated into the firearm.

Various other changes may be made to the apparatus in size, proportions, and material of construction without departing from the meaning, scope, or intent of the claims which follow.

What is claimed and desired to be secured by Letters Patent is as follows:

1. A method of correcting cant of a firearm, said firearm having barrel with a centerline axis, a stock section, a grip section, an action receiver, a mounted rotatable scope and reticle with a clamping means, and a cant measuring device, the cant measuring device comprising:

a solid block having a front side facing toward the rear of the action receiver, a back side contacting the rifle's stock section, a bottom side contacting the rifle's grip section and left and right sides parallel to the centerline axis of the barrel;

a tubular cavity bored within the solid block having a center that intersects the vertical plane of and is perpendicular to the centerline axis of the barrel having a first end open on one side and a second end closed on the other side of the solid block;

a bubble level inserted into said cavity such that when the rifle's grip section is perpendicular to the centerline axis of the barrel, the center of the bubble level is aligned with the centerline axis of the rifle's barrel such that the bubble moves perpendicular to the centerline axis of the barrel as the rifle is rotated about the centerline axis of the barrel;

a top side having a view port created by removing material from around the bubble level such that the bubble can be viewed by the rifle's shooter;

the method comprising the steps of:

placing a view target, such as a plumb line or other vertically straight element, some distance away from the location of the firearm where such view target has a clearly visible vertical element as seen through the scope;

placing the firearm in a securing means with the barrel pointing toward the view target such that the firearm may freely rotate about the centerline axis of the barrel and then be secured in a fixed position for firing at the view target;

loosening the scope clamping means so that the scope may be rotated;

orientating the firearm so that bubble is in a center of the bubble level and secure the firearm so as to prevent rotational movement of the firearm; and rotating the scope so that the vertical element of the reticle aligns with the vertically-oriented element in the view target, then tighten the scope clamping means to prevent any rotation of the scope.

2. The method of claim 1 wherein the embedded bubble level further comprises a central elongated mark locating the precise center of the bubble level that is aligned with the central axis of the barrel and a plurality of equally-spaced shorter marks on either side of the elongated center mark.

3. A method of compensating for the cant of a calibrated firearm and scope when the firing position is non-level, said firearm having barrel with a centerline axis, a stock section, a grip section, an action receiver, a mounted rotatable scope and reticle, and a cant measuring device, the cant measuring device comprising:

a solid block having a front side facing toward the rear of the action receiver, a back side contacting the rifle's stock section, a bottom side contacting the rifle's grip section and left and right sides parallel to the centerline axis of the barrel;

a tubular cavity bored within the solid block having a center that intersects the vertical plane of and is perpendicular to the centerline axis of the barrel having a first end open on one side and a second end closed on the other side of the solid block;

a bubble level inserted into said cavity such that when the rifle's grip section is perpendicular to the centerline axis of the barrel,the center of the bubble level is aligned with the centerline axis of the rifle's barrel such that the bubble moves perpendicular to the centerline axis of the barrel as the rifle is rotated about the centerline axis of the barrel;

a top side having a viewed port created by removing material from the solid block such that the cavity can be viewed by the rifle's shooter;

the method comprising the steps of:

positioning the firearm at a desired Point of Aim (POA) after compensating for all other variables other than the firearm's cant;

noting the firearm's cant by locating the position of the bubble relative to a center of the bubble level;

firing the firearm at a view target with a vertical element to obtain the Point of Impact (POI) of a projectile;

measuring a horizontal distance of the POI relative to the vertical element of the view target to obtain an offset of target accuracy due to the firearm's cant;

rotating the firearm the opposite direction of the observed cant to closer align the bubble to the center of the bubble level, firing at the view target to determine if the cant adjustment made eliminates the offset of the POI to the desired target; and repeating, if necessary, cant adjustments and subsequent firing of the firearm such that the POI matches the desired point of the view target to the precision the shooter desires.

4. The method of claim 3 comprising the additional step of adjusting vertical and horizontal angles of the barrel relative to the view target to compensate for gravity and wind effects on the projectile on travel to the view target before securing the firearm in a fixed position for firing.

* * * * *